US006113458A

United States Patent [19]

Brown

[11] Patent Number: 6,113,458

[45] Date of Patent: Sep. 5, 2000

[54] MODEL RAILWAY TRAIN CAR WITH REMOTE CONTROLLED LASER

[76] Inventor: Bruce J. Brown, 3422 Silver Maple Pl., Falls Church, Va. 22042

[21] Appl. No.: 09/237,902

[22] Filed: Jan. 27, 1999

[51] Int. Cl.[7] ..... A63H 17/28

[52] U.S. Cl. ..... 446/438; 446/465; 105/1.5

[58] Field of Search ..... 446/219, 465, 446/467, 470, 438, 24, 397; 105/1.5; 213/75 TC

[56] References Cited

U.S. PATENT DOCUMENTS

| | | | |
|---|---|---|---|
| 3,181,271 | 5/1965 | Withams | 446/397 |
| 4,010,361 | 3/1977 | Latterman et al. . | |
| 4,196,461 | 4/1980 | Geary . | |
| 4,813,905 | 3/1989 | Yamaguchi et al. | 446/397 |
| 4,814,800 | 3/1989 | Lavinsky et al. . | |
| 5,314,371 | 5/1994 | Mason | 446/24 |
| 5,348,508 | 9/1994 | Garfinkel | 446/219 |
| 5,749,547 | 5/1998 | Young et al. . | |

OTHER PUBLICATIONS

Star Graphics Laser Sign document, Oct. 28, 1998.

*Primary Examiner*—Sam Rimell

*Attorney, Agent, or Firm*—Blank Rome Comisky & McCauley

[57] ABSTRACT

A railway car for a model railroad train system has a low-power laser for providing entertainment, for example, by simulating a laser "death ray" or by producing a laser light show. When an operator activates a switch on the transformer of the model railroad train system, an electronics module on the car receives the signal and turns on the laser source. A scanning mirror system receives and deflects the laser beam to provide the laser light show or other entertaining laser pattern. The car can carry a scattering medium to make the laser beam visible on the car. The car can also produce sound effects to accompany the laser light show or other entertaining laser pattern.

27 Claims, 3 Drawing Sheets

FIG. 3A
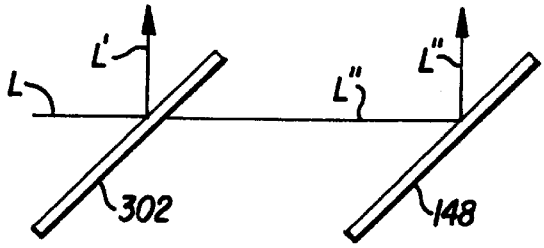
FIG. 3B
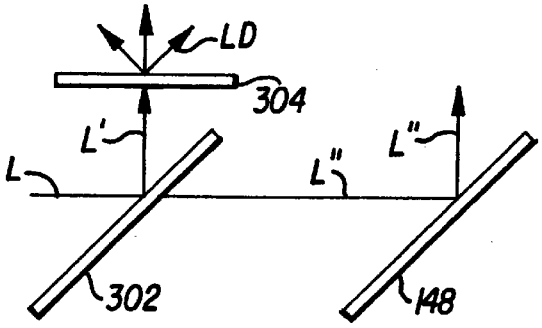
FIG. 3C
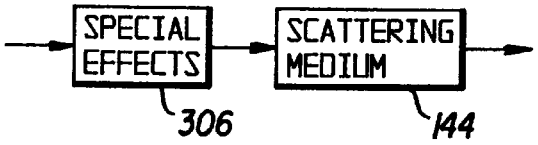
FIG. 3D
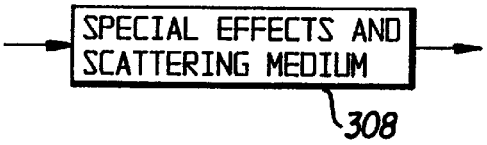
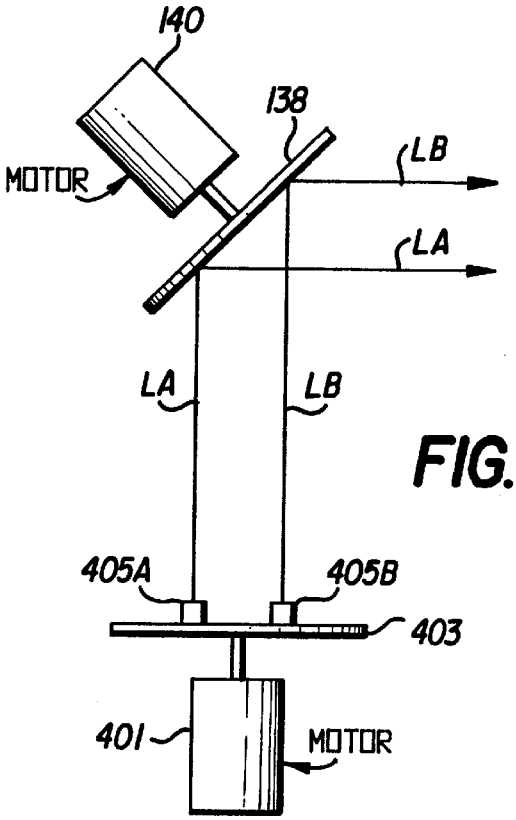
FIG. 4

MODEL RAILWAY TRAIN CAR WITH REMOTE CONTROLLED LASER

FIELD OF THE INVENTION

The present invention is directed to a model railway train system and more particularly to a model railway train system having a railway car carrying a remote controlled laser to produce an entertaining visible laser illumination pattern and sound to accompany the laser illumination pattern.

BACKGROUND OF THE INVENTION

Model railway train systems are typically powered by current supplied through the tracks. A transformer electrically connected to a conventional home wall outlet converts household alternating current into current suitable for powering the train. The HO standard model railway system uses direct current, while three-rail model railway systems such as Lionel use alternating current. The transformer is connected to the railway track to provide a potential difference between the rails. Typically, the potential difference is supplied to the wheels on the locomotive or other rail car of the model railway system via the rails to an electric motor on the locomotive or lights on a car. Alternatively, a third rail can be used to supply power via a pickup roller to the electric motor or lights.

The speed of travel of the model train on the track is generally controlled by the amplitude of the voltage applied to the rails. However, when a remote-control system is used, such as the Lionel TMCC (TrainMaster Command Control) for three-rail 0-gauge or the DCC (Digital Command Control) for HO, the voltage remains constant on the track, while an internal circuit in the engine receives digital commands through the track or by radio and controls the amount of track voltage reaching the motors. The method of reversing the direction of travel of the train varies from control system to control system.

It is known in the art to control certain aspects of the operation of a model railway train system by superimposing a DC control signal on the power supplied to the model train through the tracks. For example, a positive DC signal can be used to actuate a train whistle, while a negative DC signal can actuate a train bell. Examples of such prior art control systems are described in U.S. Pat. No. 5,749,547 to Young et al.

It is also known in the prior art to provide a model railway train car with a searchlight controlled by the voltage from the transformer or with a searchlight that can be turned on and off. The searchlight comprises an incandescent light bulb that outputs uncollimated, broad-band white light and may be turned on and off as the model railway train car passes over a special track section with an electromagnet for actuating a switch in the searchlight car. Such a light is typically not controllable by the train operator beyond the ON and OFF states and then only by directing the model railway train over the special track section. The searchlight is not accompanied by a sound effect.

In a distinctly different art from model railway trains, laser light shows have become an increasingly prominent part of mass entertainment. Such laser light shows are produced by devices such as the Star Graphics Laser Sign™ sold by Holograms & Lasers International of Houston, Tex., U.S.A., and the Black Widow and Laser Graphics FX sold by American DJ Supply, Inc., of Los Angeles, Calif., U.S.A. Such devices use low-powered lasers, typically in the 5 mW to 300 mW range, with scanning mirror assemblies to project a pattern of light. The pattern can be anything from an abstract pattern, such as a lissajous curve, to a recognizable image or even text. However, the known laser light show devices are generally fixed in position, and the pattern is visible only on a projection screen area that must be in shadow. In particular, a laser beam passing through a medium such as the surrounding air is not visible from the side because of the coherence of the laser beam unless there is enough of a scattering medium, such as smoke, in the air to scatter the laser light and thus make the laser beam visible.

SUMMARY AND OBJECTS OF THE INVENTION

In view of the foregoing limitations of the prior art model railway train systems, and in accordance with the purpose of the invention, as embodied and broadly described, it is a primary objective of the invention to provide a model railway train system with an operator-controllable visible laser light.

It is another object of the invention to provide a model railway train system with a railway car that has the capability to project a visible and controllable laser light pattern.

Another object of the invention is to provide a model railway train system with a railway car having the capability of producing a visible laser light show accompanied by sound effects all of which is remotely controllable by the operator.

It is yet another object of the invention to provide a model railway train system with a railway car having mounted thereon a laser light source combined with a scattering or disclosure medium to make the beam visible, a filtering medium to modify the beam, both kinds of media, or a single medium to perform both functions.

To achieve the foregoing and other objects, advantages and features, the present invention is directed to a model railway train car, such as a flat car, carrying a remotely controlled laser source, a mirror scanning assembly and an electronics module with circuitry for controlling operation of the laser and scanning mirror assembly. The railway car receives both its source of power and a control signal through the track. The control signal can be generated by the actuation of a bell button switch or the like. The laser source may be, for example, a 5 mW laser and the mirror scanning system for the laser beam may include one or more moving mirrors, one or more stationary mirrors, or both. Preferably, the mirror scanning system is a dual rotating mirror arrangement for deflecting the laser beam output of the laser in various patterns remotely controllable by the operator by means of a controlling signal transmitted to the electronics module through the track. Mirrors mounted on galvanometer motors can be used instead of, or along with, the rotating mirrors.

A scattering or disclosure medium is preferably provided on the railway car in the path of the laser beam to make the laser beam visible on the car itself and increase the entertainment value of the model railway train system as a whole. To further increase the entertainment value of the model railway train system, for example, the car can be denominated as a "death-ray" car and can be given the appearance of a laser weapon. The car can also carry controllable sound-generating equipment for providing sound effects to accompany a laser light show. As a further example, the combination laser light show and sound could represent an advertising or political campaign promotion, a railway-carried rock band, or the like. Other configurations and simulated uses of the railway car of the invention to improve the overall entertainment value of a model railway train system incorporating the invention will be apparent to those skilled in the art of model railway train systems.

The invention is further directed to a model railway train system, including the above-described railway car, the track, and a remote controller connected to the track with means for the operator to control the various functions of the railway car, including the laser pattern and any sound accompanying the laser pattern.

Additional features and advantages of the invention are set forth in the description which follows, and in part will be apparent from the description, or may be learned by practice of the invention. The foregoing objectives and other advantages of the invention will be realized and attained by the system and apparatus particularly pointed out in the written description and claims hereof as well as in the appended drawings.

BRIEF DESCRIPTION OF THE DRAWINGS

A preferred embodiment of the present invention will now be set forth with reference to the drawings, in which:

FIGS. 3A–3D are schematic diagrams showing modifications to the model railway laser car shown in FIG. 1; and FIG. 4 is a schematic diagram showing another modification to the model railway laser car shown in FIG. 1.

DETAILED DESCRIPTION OF THE PREFERRED EMBODIMENT

Figure 1:
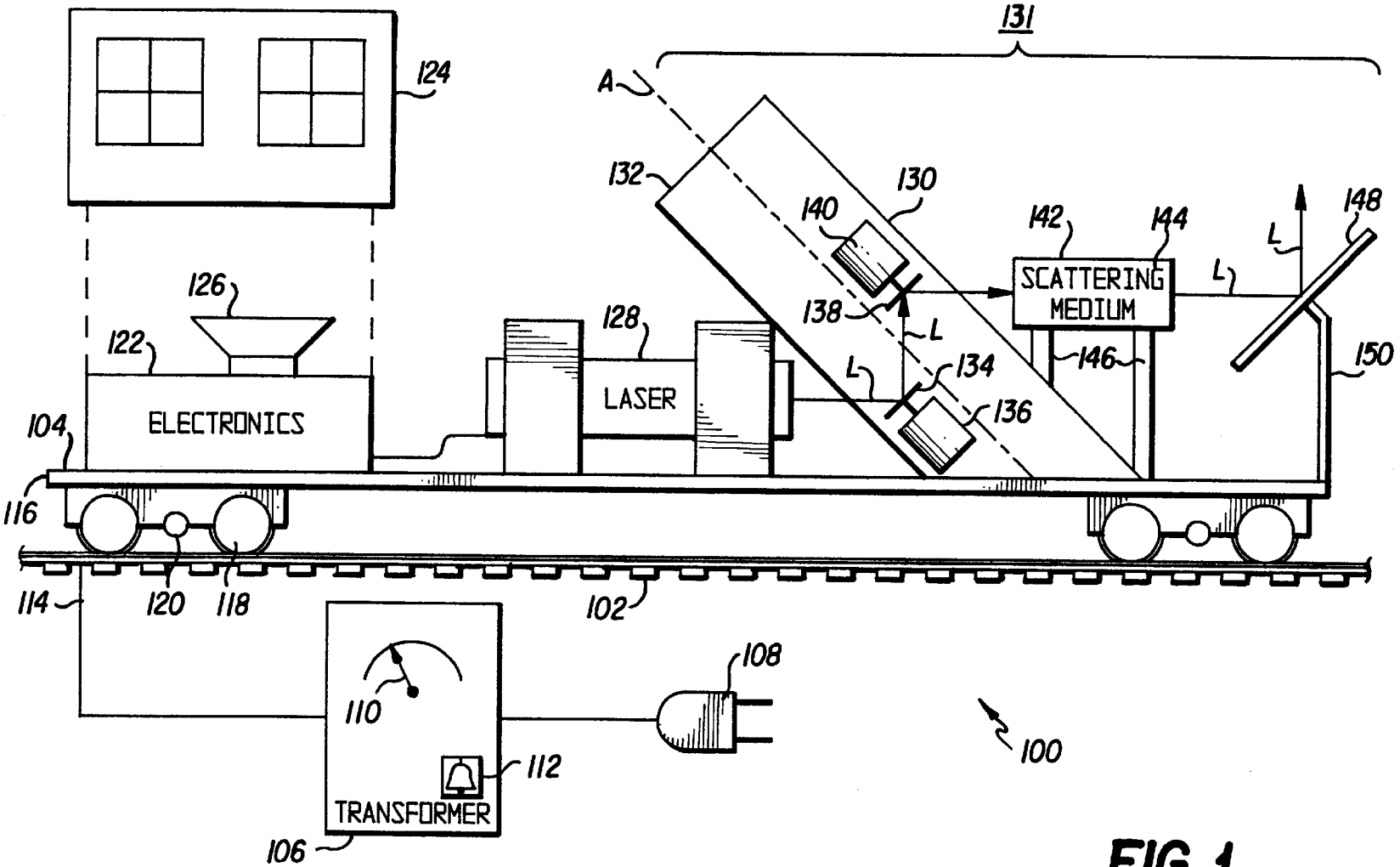
FIG. 1 is a side elevation view showing a model railway laser car according to the preferred embodiment.

Referring now to FIG. 1 of the drawings, there is shown a model train system 100 that includes a track 102 and a railway flat car 104 supported on the track. The car 104 may be used alone in a stationary position on the track, but for a full entertainment effect, it is preferably attached to other model railway cars, such as a locomotive, a caboose, various freight and passenger cars, and other cars (not shown) which are well known in the art.

The train system 100 is powered by a transformer 106 electrically connected to a wall socket by a conventional two-bladed electrical plug 108. The transformer 106 includes controls such as a speed-selection lever 110 and a switch 112, such as a bell button. The speed-selection dial 110 controls the voltage supplied to the track 102 through an electrical connection or wire 114 and thereby controls the speed and direction of motion of the car 104 in a conventional manner. The switch 112 causes a DC signal to be superimposed on the voltage supplied over the electrical connection 114. A conventional locomotive may respond to the DC signal by ringing its bell; however, as explained below, the flat railway car 104 responds to the DC signal by emitting a laser beam, which may be in the form of a laser light show, laser pattern, or the like.

The car 104 includes a car chassis 116, beneath which are mounted wheels 118 for rolling on the track 102 and pickup rollers 120 for picking up the voltage from the track 102. The voltage is received from the pickup rollers 120 by control electronics 122 concealed in a housing 124 that is configured to resemble a component of an actual railroad car. In the preferred embodiment, the flat car 104 is pulled along the track 102 by a locomotive (not shown), so that there is no requirement that the flat car 104 have its own motor. However, it is within the scope of the invention that the flatbed car could be provided with a motor, which would receive the voltage in any conventional manner, including in the manner described above.

The DC voltage signal produced by the switch 112 locks the control electronics 122 in an ON state, in a manner to be explained below with reference to FIG. 2, so that the control electronics remain in the ON state when the switch 112 is released. In the ON state, the control electronics 122 generates sound of a desired type, e.g., futuristic sounds, weapon sounds, music, words or the like, and outputs it through a speaker 126 and also powers a laser source 128, as well as the laser pattern generator means 130.

The laser source 128, which may be a class IIIa, 5 mW red LED laser such as that sold by Hosfelt Electronics, Steubenville, Ohio, U.S.A., outputs a laser beam L that is converted to a laser pattern or patterns, such as may be used in a laser light show, by a laser optics assembly 131. The first stage of the laser optics assembly 131 comprises the laser pattern generator means 130 mounted in a pattern generator housing 132, the longitudinal axis A of which is arranged at an angle of about 45° to the chassis 116 so as to orient the mirrors of the generator at an appropriate angle with respect to the axis of the laser beam L. The laser beam L entering the pattern generator housing 132, is first incident on a first mirror 134 rotated by a first motor 136 and is reflected by the first mirror 134 onto a second mirror 138 rotated by a second motor 140.

The mirrors 134 and 138 have planes of reflection that are not quite orthogonal to the axes of rotation of their motors 136 and 140. Thus, the rotation of the mirrors 134 and 138 causes a scanning effect somewhat like that of a supermarket laser scanner, so that the path of the reflected laser beam L produces a desired pattern which may be changed or programmed by varying the rates of rotation of the mirrors 134 and 138. Accordingly, the mirrors 134 and 138 and the motors 136 and 140 in combination comprise the pattern generator optics.

Of course, other scanning systems or pattern generators, such as an holographic or galvanometric scanner interfaced with appropriate control electronics, could be used instead. Of particular interest is a scanning system in which the motors 136 and 140 are galvanometric motors. A galvanometric motor, or galvanometer, is a motor is a limited-excursion motor whose shaft moves in proportion to the amount of current applied. With the current removed, the shaft returns to its rest position. Thus, the motor moves the shaft back and forth instead of spinning continuously. To draw graphics, two such galvanometers are used, each with a mirror mount and a mirror 134, 138, the galvanometers and mirrors being arranged similarly to the rotating motors and mirrors described above.

When driven by a microprocessor through scanner amplifiers, such an arrangement can draw complex patterns such as words, signs, cartoons, and other images. The laser beam L is reflected off of the mirrors 134, 138 in series, with one mirror moving horizontally and the other moving vertically. Thus, the laser beam L can be pointed in any direction within the area accessible by the scanning arrangement. While the rotating motors are now cheaper than the galvanometers, falling prices should make galvanometers more practical in a toy or model.

From the pattern generator housing 132, the laser beam L is transmitted into a container 142 filled with a disclosing or scattering medium 144. The laser beam L is visible while it passes through the disclosing medium 144; in particular, the disclosing medium 144 allows the user to view the scanning motion imparted to the laser beam L by the mirrors 134 and 138.

The disclosing medium 144 can be any suitable scattering medium, such as an aqueous suspension of a scattering substance. Suitable scattering substances are readily available, e.g., from Edmund Scientific Corporation of 101 East Gloucester Pike, Barrington, N.J. 08007-1380, U.S.A. An aqueous suspension of milk is also known to scatter laser light. Alternatively, the scattering medium 144 can be a solid material, in which case the container 142 may be eliminated. The disclosing medium 144, with or without a container 142, is supported on the chassis 116 by supports 146.

From the disclosing medium 144, the laser beam L is incident on a mirror 148 mounted on a support 150. The mirror 148 may be fixed so as to reflect the laser beam L upwardly onto the ceiling or it may be pivotable about one axis or two orthogonal axes so as reflect the laser beam L toward any desired surface, such as a wall, screen, ceiling, railroad scenery, or the like. The pattern produced by the pattern generator may be a laser light show, letters or any other desired pattern that can be programmed into the pattern generator optics. If desired, the pivoting of the mirror 148 may be remotely controllable by the operator by means of suitable motors and controls (not shown).

Figure 2:
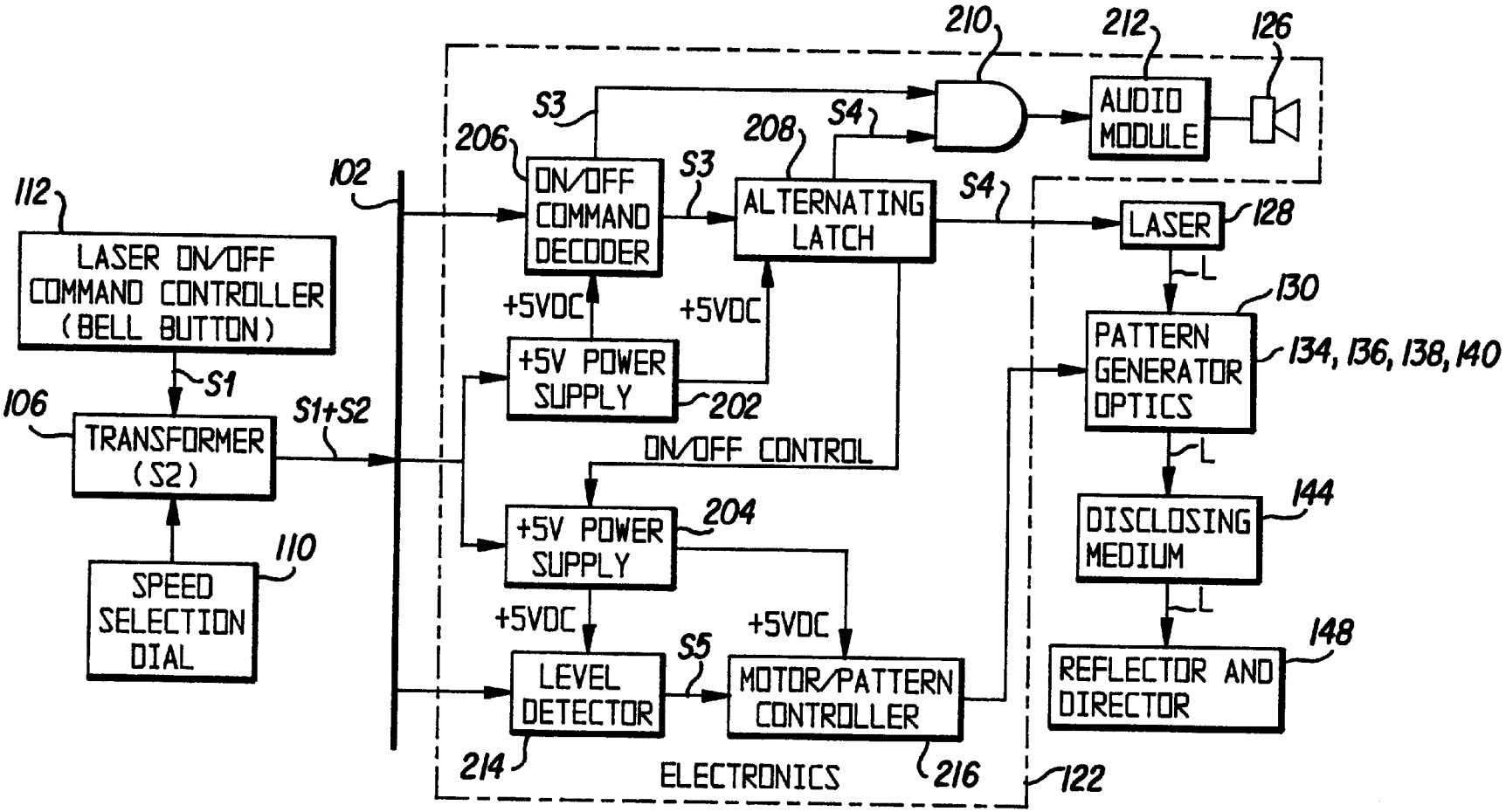
FIG. 2 is a schematic diagram showing the control electronics used by the laser car shown in FIG. 1.

The electronic components of the model railway train system 100 of the invention are illustrated in the schematic diagram of FIG. 2. Alternatively, such components could be implemented in a control system such as the above-mentioned DCC or TMCC. As shown in FIG. 2, the switch or bell button 112 functions as a laser ON/OFF command controller to supply a DC signal S1 to the transformer 106. The transformer 106 superimposes that DC signal S1 onto the power signal S2 and supplies both signals as a combined signal S1+S2 to the tracks.

The electronics 122 receive the power signal S2 with the DC signal S1 superimposed thereon from the track 102. In the electronics 122, two +5 V DC power supplies 202, 204 receive the power signal S2 and output +5 V DC power to the other components of the electronics 122. Two power supplies 202, 204 are used to prevent power line noise from the motors from affecting the laser, control and sound electronics and vice versa. Alternatively, a single power supply with two filters could be used. The ON/OFF command decoder 206, powered by the power supply 202, extracts the DC signal S1 from the bell button 112 to derive an ON signal S3 and supplies the ON signal S3 both to an alternating latch 208 and to an AND gate 210.

The alternating latch 208, also powered by the power supply 202, enters an ON state in which it outputs an ON signal S4 when the bell button 112 is depressed, remains in its ON state when the bell button 112 is released, and enters an OFF state the next time the bell button 112 is depressed. The alternating latch 208 directly controls the laser source 128, so that when the bell button 112 is depressed and released, the laser source 128 stays on until the bell button 112 is depressed again. On the other hand, the alternating latch 208 controls an audio module 212 only through the AND gate 210. Thus, the audio module 212 is on only when the ON/OFF command decoder 206 and the alternating latch 208 both output their ON signals S3 and S4, or, in other words, only when the bell button 112 is depressed and held down during the ON state of the alternating latch 208. When the audio module 212 is on, it generates a sound and outputs the sound through the speaker 126. Alternatively, a time-delay arrangement could be used. For example, when the bell button 112 is pressed, the sounds could be controlled to stay on for a preset time rather than for the duration of the bell press.

A level detector 214, powered by the power supply 204, detects the level of the power signal S2 as controlled by the speed-selection dial 110. The level detector 214 outputs a signal S5 representing the level to a motor/pattern generator 216. The motor/pattern generator 216, also powered by the power supply 204, controls the laser pattern generator optics 130, including the mirrors and motors 134, 136, 138, 140 to produce a pattern in accordance with the level of the power signal S2 as represented by the signal S5. The control can be as simple as merely changing the speeds of the motors 136 and 140, or it can involve selecting different patterns in accordance with the power level. The patterns can be generated in any suitable way, e.g., by storing them in ROM or by generating them on the fly.

Various other optics can be added to modify the beam, instead of or in combination with the scattering medium 144. Examples will now be described with reference to FIGS. 3A–3D.

Various filtering elements for modifying the beam L to produce special effects, such as diffraction gratings, holograms, dichroic filters or beam splitters, can be introduced into the path of the laser beam L, in addition to or instead of the scattering medium 144. For example, as shown in FIG. 3A, the scattering medium 144 can be replaced or augmented with a beam splitter 302, such as Edmund Scientific #V43-360, that splits the laser beam into a beam L' reflected upward and a beam L" transmitted and then reflected by the mirror 148. In a further modification shown in FIG. 3B, an optical diffusing glass 304 having a milky white coating, such as Edmund Scientific #V43-043, can be disposed in the path of the beam L' to produce a diffuse light pattern LD and thereby to render the scanned pattern visible on the car. Of course, any other special effects can be included. Also, such special effects can be provided in an optical element 306 separate from the scattering medium 144, as shown in FIG. 3C, or integrated into the scattering medium to form a single optical element 308, as shown in FIG. 3D.

Still another modification is shown in FIG. 4. According to such a modification, one or more lasers are mounted to move. For example, the laser 128, the mirror 134 and the motor 136 are replaced with a motor 401 supporting a substrate 403 on which one or more lasers 405A, 405B are mounted. The one or more lasers 405A, 405B are mounted off of the axis of rotation of the substrate 403 so that as the motor 401 turns the substrate 403, the laser beams LA, LB emitted by the lasers 405A, 405B move. The laser beams LA, LB are incident on the mirror 138, which is turned by the motor 140 as already described. The movement of the laser beams LA, LB, combine with the scanning effect provided by the mirror 138 to form a pattern.

While a preferred embodiment and various modifications thereto have been described above and in the accompanying drawings, those skilled in the art who have reviewed the present disclosure will readily appreciate that other embodiments and modifications can be realized within the scope of the invention. For example, while various modifications have been disclosed separately above, they can be combined. Also, any other effects can be applied, such as ornamentation to provide an appearance that consumers will associate with a particular use or application, such as a "death ray" or additional lights, coherent or not coherent. In addition, the laser or lasers could be replaced by any other suitable sources of collimated light. Moreover, while the car has been disclosed as remotely controlled by hard wire connections and as used in a model railway train system, a radio remote control could be used instead, and the car could be used in a toy, model or entertainment setting other than a model railway train system. Accordingly, it is intended that the invention be limited only to the extent required by the appended claims and the applicable rules of law.

What I claim is:

1. A device for producing a visible light for entertainment purposes, comprising:

a model vehicle chassis;

wheel means attached to the model vehicle chassis for engaging a surface to permit the chassis to move along the surface;

a source of collimated light mounted on the model vehicle chassis; and electronic means for receiving a signal and for activating the source of collimated light in accordance with the signal.

2. A device as in claim 1, further comprising optic means mounted on the chassis in a path of the collimated light for deflecting the collimated light to provide a visible light pattern.

3. A device for producing a visible light for entertainment purposes, comprising:

a chassis;

wheel means attached to the chassis for engaging a surface to permit the chassis to move along the surface;

a source of collimated light mounted on the chassis;

electronic means for receiving a signal and for activating the source of collimated light in accordance with the signal; and optic means mounted on the chassis in a path of the collimated light for deflecting the collimated light to provide a visible light pattern, said optic means comprising pattern generator means for scanning the collimated light to provide the light pattern.

4. A device as in claim 3, wherein the electronic means includes means for controlling the pattern generator means in accordance with the signal.

5. A device as in claim 3, wherein the optic means further comprises a mirror means for reflecting the collimated light after the collimated light has been scanned by the pattern generator means.

6. A device as in claim 1, wherein the electronic means includes means for producing a sound in accordance with the signal.

7. A device as in claim 1, wherein said surface comprises a track of a model railway train and said wheel means comprises means for engaging the track to permit the chassis to move along the track.

8. A device as in claim 7, wherein the electronic means comprises means for receiving the signal from the track.

9. A device as in claim 8, wherein the electronic means further comprises means for separating the signal received from the track into (i) a power signal for supplying power to the device and (ii) a control signal for controlling activation of the source of collimated light.

10. A device as in claim 1, further comprising a scattering medium mounted on the chassis in a path of the collimated light for making the collimated light visible as the collimated light passes through the scattering medium.

11. A device as in claim 1, further comprising a filtering means mounted on the chassis in a path of the collimated light for filtering the collimated light as the collimated light passes through the filtering means.

12. A device as in claim 1, wherein the source of collimated light is a laser.

13. A device as in claim 1, further comprising a motor for moving the source of collimated light relative to the chassis.

14. A model railway train system for providing a visible light for entertainment purposes, the system comprising:

(a) a model railway car comprising:

a chassis;

wheel means attached to the chassis for engaging with a track to permit the chassis to move along the track;

a source of collimated light mounted on the chassis; and electronic means for receiving a signal for activating the source of collimated light in accordance with the signal; and (b) remote-control means for receiving an operator command for generating the signal in accordance with the command and for supplying the signal to the electronic means.

15. A system as in claim 14, including optic means mounted on the chassis in a path of the collimated light as the collimated light exits the laser source for deflecting the collimated light to provide a light show.

16. A system as in claim 15, wherein the optic means comprises pattern generator means for scanning the collimated light to provide the light show.

17. A system as in claim 16, wherein the electronic means comprises means for controlling the pattern generator means in accordance with the signal.

18. A system as in claim 16, wherein the optic means further comprises mirror means for reflecting the collimated light after the collimated light has been scanned by the pattern generator means.

19. A system as in claim 14, wherein the electronic means comprises means for producing a sound in accordance with the signal.

20. A system as in claim 14, wherein the electronic means comprises means for receiving the signal from the track.

21. A system as in claim 20, wherein the electronic means further comprises means for separating the signal received from the track into (i) a power signal for supplying power to the system and (ii) a control signal for controlling activation of the source of collimated light.

22. A system as in claim 21, wherein the remote-control means comprises a switch for generating the control signal and a transformer for generating the power signal and for superimposing the control signal on the power signal to produce the signal supplied to the electronic means.

23. A system as in claim 14, further comprising a scattering medium mounted on the chassis in a path of the collimated light for making the collimated light visible as the collimated light passes through the scattering medium.

24. A system as in claim 14, further comprising a filtering means mounted on the chassis in a path of the collimated light for filtering the collimated light as the collimated light passes through the filtering means.

25. A system as in claim 14, wherein the remote-control means comprises switch means for generating a control signal and a transformer for generating a power signal and for superimposing the control signal on the power signal to produce the signal supplied to the electronic means.

26. A system as in claim 14, wherein the source of collimated light is a laser.

27. A system as in claim 14, wherein the model railway car further comprises a motor for moving the source of collimated light relative to the chassis.

* * * * *